United States Patent [19]

Brewer et al.

[11] Patent Number: 4,881,985

[45] Date of Patent: Nov. 21, 1989

[54] METHOD FOR PRODUCING ANISOTROPIC RE-FE-B TYPE MAGNETICALLY ALIGNED MATERIAL

[75] Inventors: Earl G. Brewer, Warren; Robert W. Lee, Troy, both of Mich.; John J. Croat, Noblesville, Ind.

[73] Assignee: General Motors Corporation, Detroit, Mich.

[21] Appl. No.: 228,435

[22] Filed: Aug. 5, 1988

[51] Int. Cl.[4] ..... H01F 1/02

[52] U.S. Cl. ..... 148/103; 148/105; 75/0.5 R

[58] Field of Search ..... 148/101, 102, 103, 104, 148/105; 75/0.5 R

[56] References Cited

U.S. PATENT DOCUMENTS 4,496,395 1/1985 Croat ..... 148/301
4,710,239 12/1987 Lee et al. ..... 148/101

FOREIGN PATENT DOCUMENTS 0108474 5/1984 European Pat. Off. .
0133758 3/1985 European Pat. Off. .

*Primary Examiner*—John P. Sheehan
*Attorney, Agent, or Firm*—George A. Grove

[57] ABSTRACT

A method to produce rare earth (RE), iron, boron type anisotropic permanently magnetic material includes forming magnetically isotropic coarse powder particles of melt-spun alloy with a very fine grain $RE_2FE_{14}B$ phase. The particles are mixed with inert particles of a size and of a weight percentage of the mixture to separate the powder particles for preventing hot work bonding therebetween. The mixture is hot pressed to cause the magnetically isotropic particles to be compressed in a direction parallel to the press direction so as to strain the particles to cause crystallites to be oriented along a crystallographically preferred magnetic axis resulting in particles of anisotropic permanently magnetic material.

14 Claims, 2 Drawing Sheets

METHOD FOR PRODUCING ANISOTROPIC RE-FE-B TYPE MAGNETICALLY ALIGNED MATERIAL

This invention relates to a method for hot working magnetically isotropic powder particles of finely crystalline alloys containing one or more light rare earth (RE) elements, one or more transition metals (TM) and boron with an Nd-Fe-B type intermetallic phase so as to cause crystallites to be configured to produce resultant anisotropic powder particles

BACKGROUND OF THE INVENTION

Permanent magnet compositions based on the rare earth (RE) elements neodymium or praseodymium or both, the transition metal iron or mixtures of iron and cobalt, and boron are known. Preferred compositions contain a large proportion of an $RE_2TM_{14}B$ phase where TM is one or more transition metal elements including iron. A preferred method of processing such alloys involves rapidly solidifying molten alloy to achieve a substantially amorphous to very finely crystalline microstructure that has isotropic, permanently magnetic properties. In another preferred method, overquenched alloys without appreciable coercivity can be annealed at suitable temperatures to cause grain growth and thereby induce magnetic coercivity in a material having isotropic permanently magnetic properties.

It is also known that particles of rapidly solidified RE-Fe-B based isotropic alloys can be hot pressed into a substantially fully densified body and that such body can be further hot worked and plastically deformed to make an excellent anisotropic permanent magnet. Thus, alloys with overquenched, substantially amorphous microstructures are worked and plastically deformed at elevated temperatures to cause grain growth and crystallite orientation which result in substantially higher energy products than in the best as-rapidly-solidified alloys. The maximum energy product to date for hot worked, melt-spun Nd-Fe-B magnet bodies is up to about 50 MGOe, although energy product as high as 64 MGOe are theoretically possible.

As stated above, the preferred rare earth (RE)-transition metal (TM)-boron (B) permanent magnet composition consists predominantly of $RE_2TM_{14}B$ grains with an RE-containing minor phase(s) present as a layer at the grain boundaries. It is particularly preferred that on the average the $RE_2TM_{14}B$ grains be no greater than about 500 nm in greatest dimension in the permanent magnet product.

While such hot die upsetting is suitable for its intended purpose, in certain manufacturing processes it would be desirable to directly convert the isotropic particles to anisotropic permanently magnetic particles. Such anisotropic particles can then be mixed with a suitable matrix material and shaped to form a bonded permanent magnet having magnetically anisotropic properties.

STATEMENT OF THE INVENTION AND ADVANTAGES

The present invention contemplates a method and apparatus for making particles of permanent magnetically anisotropic material from melt-spun ribbon particles of amorphous or finely crystalline material having grains of $RE_2TM_{14}B$ where RE is one or more rare earth elements at least sixty percent of which is rare earth material such as neodymium and/or praseodymium, TM is iron or iron cobalt combinations and B is the element boron. The ribbon is fragmented, if necessary, into individual particles of such isotropic material. The individual particles are then heated to a plastic state and individually worked to deform each particle to align crystallites or grains therein along a magnetically preferred axis and to form flakes of material which are not fused. The flakes with such aligned crystallites are then individually cooled and collected for use in the manufacture of permanent magnets having magnetically anisotropic properties.

A feature of the present invention is to provide a method wherein the individual particles of magnetically isotropic material are hot worked with a quantity of nonreactive, noncompressible media so as to deform the particles to align the crystallite grain structure therein along a crystallographically preferred magnetic axis without fusing the individual particles together.

A further feature of the method of the present invention is to provide a method of the type set forth in the preceding paragraphs wherein the isotropic particles are heated and pressure formed when mixed with such a media having a particle size of the same or finer mesh size as the isotropic particles and which encapsulate the isotropic particles and transfer press loads thereto to cause desired crystallographic alignment in the isotropic particles.

Yet another feature of the present invention is that the isotropic particles are processed with the encapsulating media to form a solid compact from which anisotropic particles having a greatest dimension of from 45 to 250 um (obtained from American Standard Mesh sizes 325.60 can be separated for use in the subsequent manufacture of magnet products.

Still another feature of the present invention is to provide methods of the type set forth above including sizing the individual particles of isotropic starting material and encapsulating material in the range of from 45 to 250 um to form a resultant anisotropic flake material suitable for mixing with matrix material from which different shaped permanent magnetically anisotropic magnets can be subsequently processed.

BRIEF SUMMARY OF THE PREFERRED EMBODIMENT

Our method is applicable to compositions comprising a suitable transition metal component, a suitable rare earth component, and boron.

The transition metal component is iron or iron and (one or more of) cobalt, nickel, chromium or manganese. Cobalt is interchangeable with iron up to about 40 atomic percent. Chromium, manganese and nickel are interchangeable in lower amounts, preferably less than about 10 atomic percent. Zirconium and/or titanium in small amounts (up to about 2 atomic percent of the iron) can be substituted for iron. Very small amounts of carbon and silicon can be tolerated where low carbon steel is the source of iron for the composition. The composition preferably comprises about 50 atomic percent to about 90 atomic percent transition metal component —largely iron.

The composition also comprises from about 10 atomic percent to about 50 atomic percent rare earth component. Neodymium and/or praseodymium are the essential rare earth constituents. As indicated, they may be used interchangeably. Relatively small amounts of other rare earth elements, such as samarium, lanthanum, cerium, terbium and dysprosium, may be mixed with neodymium and praseodymium without substantial loss of the desirable magnetic properties. Preferably they make up no more than about 40 atomic percent of the rare earth component. It is expected that there will be small amounts of impurity elements with the rare earth component.

The composition contains at least 1 atomic percent boron and preferably about 1 to 10 atomic percent boron.

The overall composition may be expressed in the general formula $RE_{1-y}B_y)_x$. The rare earth (RE) component makes up 10 to 50 atomic percent of the composition (x =0.5 to 0.9), with at least 60 atomic percent of the rare earth component being neodymium and/or praseodymium. The transition metal (TM) as used herein makes up about 50 to 90 atomic percent of the overall composition, with iron representing about 80 atomic percent of the transition metal content. The other constituents, such as cobalt, nickel, chromium or manganese, are called "transition metals" insofar as the above empirical formula is concerned Boron is present in an amount of about 1 to 10 atomic percent (y=0.01 to 0.11) of the total composition.

The practice of our invention is applicable to a family of iron-neodymium and/or praseodymium-boron containing compositions which are further characterized by the presence or formation of the tetragonal crystal phase specified above, illustrated by the atomic formula $RE_2TM14B$, as the predominant constituent of the material. In other words, the hot worked permanent magnet product contains at least fifty percent by weight of this tetragonal phase The suitable composition also contains at least one additional phase, typically a minor phase at the grain boundaries of the $RE_2TM_{14}B$ phase. The minor phase contains the rare earth constituent and is richer in content of such constituent than the major phase.

For convenience, the compositions have been expressed in terms of atomic proportions. Obviously these specifications can be readily converted to weight proportions for preparing the composition mixtures.

For purposes of illustration, our invention will be described using compositions of approximately the following proportions:

$Nd_{0.3}(Fe_{0.95}B_{0.05})_{0.87}$

However, it is to be understood that our method is applicable to a family of compositions as described above.

Such compositions are melted, e.g., by arc melting, to form alloy ingots. The ingots are remelted and melt spun, i.e., discharged, through a nozzle having a small diameter outlet onto a rotating chill surface. The molten metal alloy is thus solidified almost instantaneously and comes off the rotating surface in the form of small ribbon-like particles.

The resultant product may be amorphous or it may be a very finely crystalline material with crystallites or grains within the microstructure having a generally spherical shape. If the material is crystalline, it contains the $Nd_2Fe_{14}b$ type intermetallic phase which has high magnetic symmetry. The quenched material is magnetically isotropic as formed.

Depending on the rate of cooling, molten transition metal-rare earth-boron compositions can be solidified to have microstructures ranging from:

(a) amorphous (glassy) and extremely fine grained microstructures (e.g., less than 20 nanometers in largest dimension) through (b) very fine (micro) grained microstructures (e.g., 20 nm to about 400 or 500 nm) to (c) larger grained microstructures.

Thus far, large grained microstructure melt-spun materials have not been produced with useful permanent magnet properties. Fine grain microstructures, where the grains have a maximum dimension of about 20 to 500 nanometers, have coercivity and other useful permanent magnet properties. Amorphous materials do not. However, some of the glassy microstructure materials can be annealed to convert them to fine grain permanent magnets having isotropic magnetic properties. Our invention is applicable to such overquenched, glassy materials. It is also applicable to "as-quenched" high coercivity, fine grain materials. Care must be taken to avoid excessive time at high temperature to avoid coercivity loss associated with excessive grain growth.

Such melt-spun ribbon particles can be broken into a coarse powder particle size and hot worked by a die upset press so as to exhibit a high degree of magnetic alignment in a direction parallel to the press direction. In accordance with the invention, such ribbon-formed alloy is broken into coarse powder particles sized in the order of 150 um.

The process of the present invention directs hot working pressure on individual ribbon particles to cause parallel alignment of the crystallites' crystallographically preferred magnetic axes during the hot working steps. This magnetic alignment occurs normal to the direction of plastic flow in the particles. The resultant individual ribbon fragments are anisotropic and can be used to form magnets fabricated by known methods.

Specifically, our inventive process includes the steps of fragmenting the melt-spun ribbon material into coarse powder particles preferably with the greatest dimensions less than 250 um and smallest dimension greater than 45 um. Such powder particles will hereafter be referred to as "coarse powder particles".

The present invention enables such coarse powder particles to be converted from magnetically isotropic material to magnetically anisotropic material with the crystallographically preferred magnetic axis perpendicular to the flat faces of each of the powder particles.

Several proposals have been suggested to hot work the individual powder particles to produce such preferred crystallographic alignment.

The present invention includes a process wherein the coarse powder particles are encapsulated by a second medium to form a deformable mixture. The deformable mixture is then hot die upset to cause individual coarse powder particles to be deformed so as to produce desired crystallographic alignment.

Furthermore, the present invention features selecting a second medium which is separable from the mixture following deformation of the individual coarse powder particles so as to produce a resultant plurality of individual anisotropic particles for use in roll or press manufacture of various magnet shapes.

The second medium is selected from material which is nonreactive to the magnetically isotropic melt-spun fragments of $RE_2Fe_{14}B$ alloy at the hot-work temperatures. The second medium is also noncompressible and is nonmagnetic.

The second medium also has a mesh size corresponding to that of the coarse powder particles of magnetically isotropic material.

In a first embodiment of the inventive method, the second medium is a nonmagnetic material which can be separated from resultant magnetically anisotropic coarse powder particles by crushing a preform mixture of the second medium and such coarse powder particles following hot working and passing the crushed mixture with respect to means for selectively attracting the anisotropic coarse powder particles for separation thereof from the second medium.

In a second embodiment of the inventive method, the second medium is a liquid during hot pressing; lateral flow of the hot worked coarse powder particle matrix is accomplished by drawing off some of the liquid during hot working.

In both embodiments of the inventive method, the broken ribbon of coarse powder particles is sieved to a predetermined coarse powder particle range preferably having maximum particle dimensions of from 45 to 250 um.

Such particles constitute a first medium in a mixture to be hot worked in accordance with the invention so as to cause individual ones of the coarse powder particles to be deformed by hot working to align crystallites therein along a crystallographically preferred magnetic axis in a direction parallel to the press direction.

In the first embodiment method, a second medium is selected from a suitable nonreactive, noncompressible, nonmagnetic category of materials. An example of such material is $SiO_2$ (silica sand), which is ground and sieved to separate the silica sand to coarse powder particles having the greatest dimension thereof in the range of from 45 to 250 um. The silica sand and magnetically isotropic hot melt-spun ribbon particles are mixed together and then are placed in a suitable hot working device such as a graphite die cylinder having tungsten carbide rams therein capable of applying a pressure of 15 KSI on the mixture.

The graphite die is inductively heated and the mixture is hot pressed to cause crystallites in the individual particles to be crystallographically aligned along a preferred magnetic axis and to produce a resultant compact. The resultant compact is then crushed to produce a fine powder mixture.

The fine powder mixture is passed through a suitable separating device including a vibrating magnet to remove individual coarse powder particles of anisotropic magnetic material from the crushed powder mixture. The separated particles retain their individual anisotropy so as to be suited for inclusion in polymer matrices suitable for roll or press shaping into final magnet configurations.

In the second embodiment method, the nonmagnetic nonreactive media is a glass powder at ambient conditions. The glass powder particles are of similar particle size as the ribbon particles and the two media are mixed as in the case of the first embodiment. The mixture is heated in the hot working press to cause the glass to become liquid and encapsulate plastic state (nonliquid) ribbon particles. Following lateral deformation of the ribbon particles, the mixture is cooled, ground and separated.

The aforesaid objects and advantages of our invention will be better understood from the succeeding detailed description of the invention and the accompanying drawings thereof.

DETAILED DESCRIPTION OF THE DRAWINGS

DETAILED DESCRIPTION OF THE INVENTION

Figure 1:
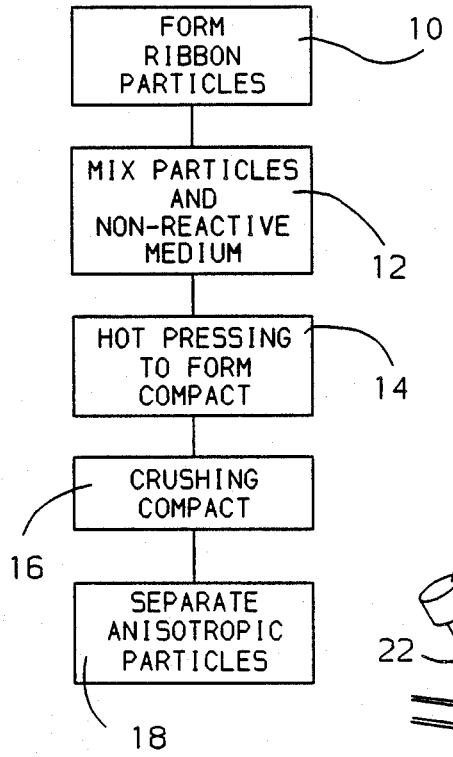
FIG. 1 is a chart showing the process of the present invention.

Referring now to FIG. 1, the inventive method of the present invention includes the following generalized steps:

1. Forming 10 ribbon particles of magnetically isotropic material.
2. Mixing 12 the individual particles with nonreactive particles of encapsulating material.
3. Hot pressing 14 the mixture to form a compact.
4. Crushing 16 the compact to a fine powder.
5. Separating 18 the treated melt-spun ribbon particles from the encapsulating material.

The forming step 10 of our invention is applicable to high coercivity, fine grain materials comprised of basically spherically shaped, randomly oriented $Nd_2Fe_{14}B$ grains with rare earth-rich grain boundaries.

Figure 2:
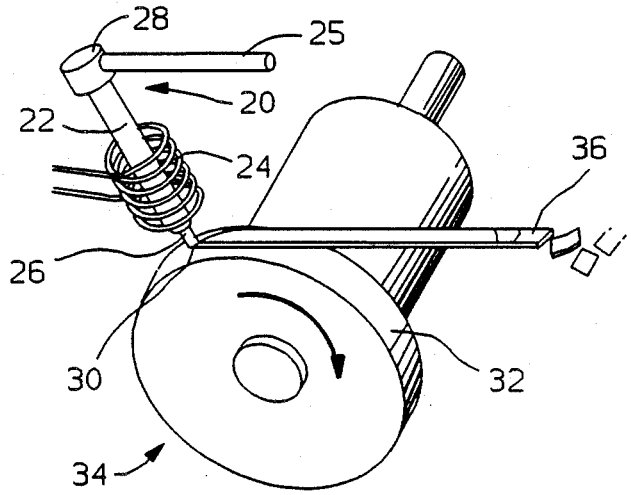
FIG. 2 is a diagrammatic view of apparatus for making magnetically isotropic ribbon particles.

Suitable compositions can be made by melt spinning apparatus 20 as shown in FIG. 2. The Nd-Fe-B starting material is contained in a suitable vessel, such as a quartz crucible 22. The composition is melted by an induction or resistance heater 24. The melt is pressurized by a source 25 of inert gas, such as argon. A small, circular ejection orifice 26 about 500 microns in diameter is provided at the bottom of the crucible 22. A closure 28 is provided at the top of the crucible so that the argon can be pressurized to eject the melt from the vessel in a very fine stream 30.

The molten stream 30 is directed onto a moving chill surface 32 located about one-quarter inch below the ejection orifice. In examples described herein, the chill surface is a 25 cm diameter, 1.3 cm thick copper wheel 34. The circumferential surface is chrome plated. For batches less than 100 gm, the wheel is not cooled since its mass is so much greater than the amount of melt impinging on it in any run that its temperature does not appreciably change. However, the wheel should be water cooled for larger runs. When the melt hits the turning wheel, it flattens, almost instantaneously solidifies and is thrown off as a ribbon or ribbon particles 36. The thickness of the ribbon particles 36 and the rate of cooling are largely determined by the circumferential speed of the wheel. In this work, the speed can be varied to produce a desired fine grained ribbon for practicing the present invention.

The cooling rate or speed of the chill wheel preferably is such that a fine crystal structure is produced which, on the average, has $RE_2TM_{14}B$ grains no greater than about 500 nm in greatest dimension.

Figure 3:
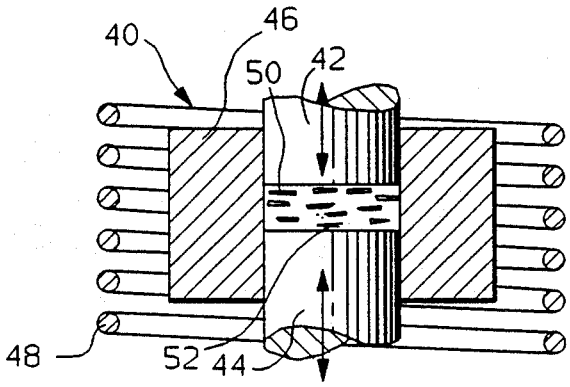
FIG. 3 is a diagrammatic view of apparatus for hot working the ribbon particles of FIG. 2.

FIG. 3 shows a hot upset die apparatus 40 having tungsten carbide rams 42, 44 driven with respect to a graphite die 46 to compact and hot work a mixture contained therein by the process of the present invention. An induction heater coil 48 inductively heats the die 46 to carry out a hot pressing operation.

In one embodiment, the isotropic ribbon particles are powdered and sieved to a $325<X<60$ mesh size. The resultant sieved particles 50 are mixed with a second medium that is made of similarly sized particles 52. The second medium includes the following properties:

1. The second medium particles 52 are nonreactive with the melt spun ribbon particles 50 under hot pressing conditions.
2. The second medium particles 52 are incompressible at the hot pressing pressure.
3. The second medium particles 52 are nonmagnetic.

The melt-spun ribbon particles 50 are mixed with the second medium particles 52 and are placed in the die 46. The resultant mixture (diagrammatically shown in FIG. 3) is then hot pressed to form a compact. The compact is cooled and reground to a powder 45 to 250 um which is processed to extract the treated melt-spun ribbon particles.

The following examples illustrate the invention.

EXAMPLE 1

Melt-spun isotropic ribbon is powdered, then sieved to $325<X<60$ mesh. This is then mixed with a quantity of nonreactive, noncompressible, nonmagnetic media of the same or finer mesh size. The resultant mixture is then hot pressed. After cooling, the resultant compact is ground to a powder, and the treated isotropic ribbon powder is extracted magnetically.

In this example, 6 gm of overquenched melt-spun isotropic ribbon was powdered and sieved to $325<X<60$ mesh. The powdered material was mixed with 5 gm of silica sand, also ground and sieved to $325<X<60$ mesh. The mixture was then hot pressed in a graphite die using tungsten carbide rams to a pressure of 15 KPSI. The graphite die was heated inductively to 725° C. The hot pressing occurred in a vacuum, to minimize oxidation. The resultant compact, after cooling, was then crushed in a mortar to a fine powder.

The treated ribbon powder material was then separated, using a vibrating magnet, from the silica sand. The vibration of the magnet served to separate out mechanically trapped silica sand from the treated ribbon powder.

Figure 4:
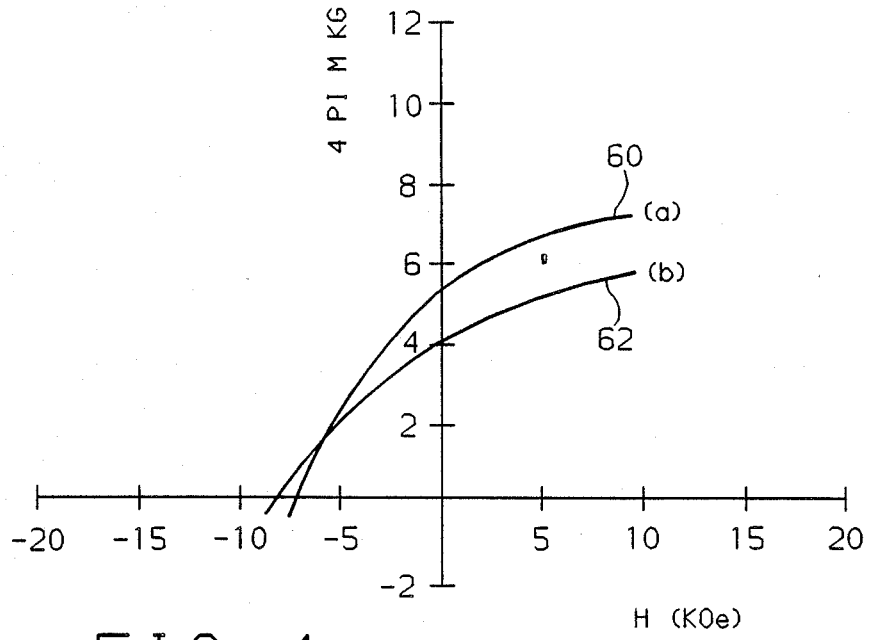
FIG. 4 is a resultant demagnetization curve of magnetically anisotropic material formed by the process of FIG. 1.
Figure 5:
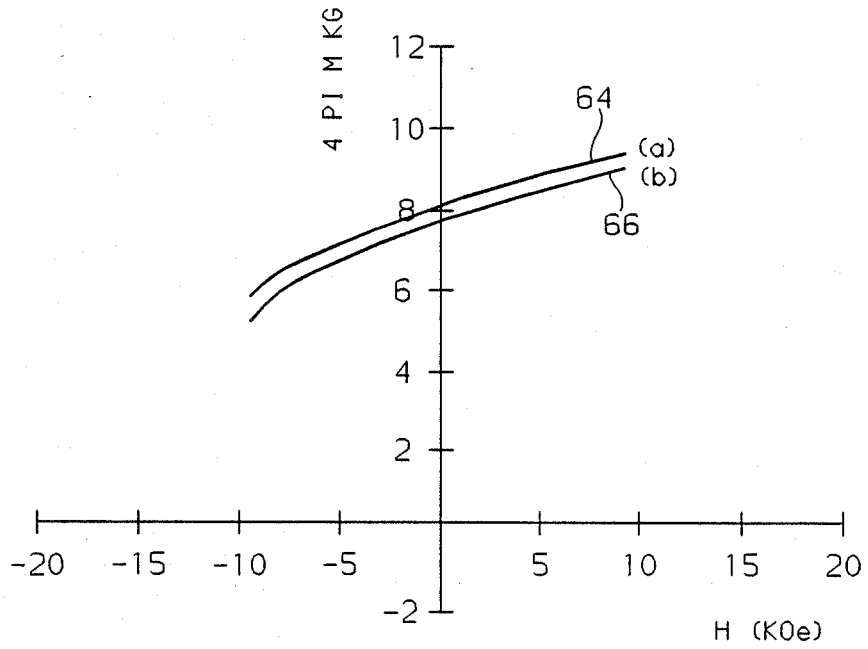
FIG. 5 is a resultant demagnetization curve of unmixed ribbon particles annealed at the same thermal cycle as particles processed by the process of FIG. 1.

A sample of the treated ribbon particles was then mixed with molten paraffin and allowed to solidify in a magnetic field. The resultant demagnetization curves are shown in FIG. 4. FIG. 5 shows the demagnetization curves for unmixed isotropic powder particles annealed at the same thermal cycle as the treated powder but without hot press deformation. The annealed (but undeformed) particles were also mixed in molten paraffin and allowed to solidify in the same magnetic field.

The level of magnetization of the treated particles in FIG. 4 is somewhat lower than in the annealed particles of FIG. 5. This is attributable to use of silica sand as the mixing media. Such media, while substantially nonreactive, does produce a slight reaction with melt-spun particles. Nevertheless, the example produced alignment in the treated powder particles (hot work deformed) approximately three times that of the annealed powder as shown by the residual magnetization measured parallel to and perpendicular to the aligning field direction as shown by curves 60, 62 in FIG. 4 compared to curves 64, 66 in FIG. 5.

EXAMPLE 2

This example can be identical to Example 1, but can include a second medium less reactive than silica sand such as nonreactive mixing media from particles of any one of the following materials: TiN, AlN, NdN, HfN, ZrN, or $Y_2O_3$ or salts such as NaCl.

EXAMPLE 3

A variation of the Example 1 press method can include use of a nonreactive media that is mixed to cover melt-spun isotropic ribbon particles to prevent such ribbon particles from sticking together (bonding) during a first pressing operation conducted either at ambient temperatures or at the elevated hot working temperature (750° C.). Then a second press (for example at 750° C.) is applied to the mixture in a larger die cavity. The larger cavity size is selected to induce lateral flow in the ribbon particles to produce reduction of ribbon thickness.

EXAMPLE 4

Still another variation would be to use a liquid, nonmagnetic, nonreactive media, e.g., a glass such as Corning Glass #7570 Solder Glass, a tradename of Corning Glass Company. Such glass is liquid at the press temperature. A premix of the glass and isotropic ribbon powder would be heated in die apparatus to a temperature where the glass is liquid and the isotropic ribbon particles are "plastic". The glass powder which is dry under ambient conditions becomes liquid at hot working temperatures. The liquid will both encapsulate and lubricate the plastic isotropic particles. The mixture is placed in a die apparatus having a porous punch or die wall. This permits some of the liquid glass to escape during compaction and provides room for lateral flow of the plastic ribbon particles in the residual lubricating liquid glass. Then upon cooling, the glass and treated deformed ribbon fragments can be separated by grinding and magnetic separation.

In another embodiment, a mixture of finely ground glass powder (or fret) and ribbon particles are preheated to the hot working temperature and hot rolled. The glass is a viscous liquid at the hot rolling temperature and serves to prevent the ribbon particles from welding together or to the hot rolls. The hot rolls deform the ribbon particles, flattening them and aligning the fine crystal grains therein.

The deformed mixture quickly hardens following the hot working and the ribbon particles are bonded together in a glass matrix. Upon further cooling, the mass can be crushed and broken up and the magnetic particles removed from the glass by magnetic separation. The deformed particles are magnetically anisotropic and suitable for alignment in a magnetic field and bonding or other consolidation with a resin into a strong, useful magnet.

While representative embodiments of apparatus and processes of the present invention have been shown and discussed, those skilled in the art will recognize that various changes and modifications may be made within the scope and equivalency range of the present invention.

The embodiments of the invention in which an exclusive property or privilege is claimed are defined as follows:

1. A method of making magnetically anisotropic powder of a composition comprising iron, neodymium/praseodymium and boron, said powder either having appreciable coercivity as processed or being heat treatable to acquire such coercivity, said method comprising:

preparing a molten mixture comprising a transition metal (TM) taken from the group consisting of iron and mixtures of iron and cobalt, one or more rare earth metals (RE) including neodymium and praseodymium, and boron, the proportions of such constituents being sufficient to form a product that upon crystallization consists essentially of the tetragonal crystalline compound having the empirical formula $RE_2TM_{14}B$;

rapidly solidifying such mixture to form magnetically isotropic particles of an amorphous material or of a very finely crystalline material containing said compound and having small, generally spherical grains of an average size no greater than about 500 nm;

mixing the magnetically isotropic particles with a material that is substantially nonreactive with the isotropic particles and noncompressible at the temperature at which the particles are hot worked;

hot working the mixture of isotropic particles and nonreactive material to cause crystallites therein to be oriented along a crystallographically preferred magnetic axis to form anisotropic particles; and separating the nonreactive material from the anisotropic particles to produce a resultant hot worked particle size and crystallographically oriented to be suitable for use in the manufacture of magnet products.

2. In the method of claim 1, said mixing step including providing the nonreactive material in particle form; mixing particles of the nonreactive material with particles of the isotropic powder.

3. In the method of claim 1, providing noncompressible, substantially nonreactive material which is nonmagnetic.

4. In the method of claim 1, providing a substantially nonreactive, nonmagnetic material in particle form having a particle size substantially equal to or less than the particle size of the isotropic particles.

5. In the method of claim 4, employing silica sand as the nonreactive material.

6. In the method of claim 4, providing a nonreactive material selected from the group consisting of TiN, AlN, NdN, HfN, ZrN and $Y_2O_3$.

7. In the method of claim 4, selecting the nonreactive material to have dry particle form at ambient conditions and to be liquid at the hot working temperatures; and extracting a part of the liquid during hot working for allowing deformation of the isotropic material and resultant crystallite deformation.

8. In the method of claim 1, hot working the mixture by placing it in a first hot working die and compressing to prevent the isotropic particles from sticking together to form a first compact; and thereafter placing the mixture in a second hot working die of a dimension greater than the greatest dimension of the compact and hot working it to cause deformation of the isotropic particles by conforming the compact to the dimensions of the second hot working die.

9. A method for manufacturing magnetically anisotropic material from coarse powder particles of magnetically isotropic material of $RE_2Fe_{14}B$ with a rare earth-rich grain boundary structure comprising the steps of:

melt spinning a molten mixture of $RE_2Fe_{14}B$ material to form a ribbon of magnetically isotropic material;

fragmenting the ribbon to form a coarse particles of magnetically isotropic material;

mixing the coarse isotropic particles with a coarse grained media of grain size equal or less than that of said coarse isotropic particles to form nonreactive, noncompressive, nonmagnetic material around each of the coarse isotropic particles;

hot working the mixture without bonding the isotropic particles;

compacting the mixture so as to form a compact comprised of the mixture; and breaking up the compact and magnetically separating the magnetically anisotropic material from the broken compact.

10. In the method of claim 9, employing silica sand as the coarse grained media.

11. In the method of claim 9, mixing the coarse isotropic particles with a coarse grained media which is liquid under hot working conditions; and extracting a part of the liquid during hot working for allowing deformation of the coarse isotropic particles.

12. In the method of claim 9, providing a nonreactive material selected from the group consisting of TiN, AlN, NdN, HfN, ZrN and $Y_2O_3$.

13. In the method of claim 9, hot working the mixture by placing it in a first hot working die and compressing to prevent the isotropic particles from sticking together to form a first compact; and thereafter placing the mixture in a second hot working die of a dimension greater than the greatest dimension of the compact and hot working it to cause deformation of the isotropic particles by conforming the compact to the dimensions of the second hot working die.

14. A method of making magnetically anisotropic powder of a composition comprising iron, neodymium/praseodymium and boron, said powder either having appreciable coercivity as processed or being heat treatable to acquire such coercivity, said method comprising:

preparing a molten mixture comprising a transition metal (TM) taken from the group consisting of iron and mixtures of iron and cobalt, one or more rare earth metals (RE) including neodymium and praseodymium, and boron, the proportions of such constituents being sufficient to form a product that upon crystallization consists essentially of the tetragonal crystalline compound having the empirical formula $RE_2TM_{14}B$;

rapidly solidifying such mixture to form magnetically isotropic particles of an amorphous material or of a very finely crystalline material containing said compound and having small, generally spherical grains of an average size no greater than about 500 nm;

mixing the magnetically isotropic particles with a material that is nonmagnetic and substantially nonreactive with the isotropic particles and noncompressible at the temperature at which the particles are hot worked;

hot working the mixture of isotropic particles and nonreactive material to cause crystallites therein to be oriented along a crystallographically preferred magnetic axis to form anisotropic particles; and magnetically separating the nonreactive material from the anisotropic particles to produce a resultant hot worked particle sized and crystallographically oriented to be suitable for use in the manufacture of magnet products.

* * * * *